US008675838B2

(12) United States Patent
Gioia et al.

(10) Patent No.: US 8,675,838 B2
(45) Date of Patent: Mar. 18, 2014

(54) INTERCOM UNIT FOR PROVIDING A STATUS ALERT FOR A MOVABLE BARRIER

(75) Inventors: William G. Gioia, Winfield, IL (US); Robert Rainey, Riverside, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 2005 days.

(21) Appl. No.: 11/537,863

(22) Filed: Oct. 2, 2006

(65) Prior Publication Data

US 2008/0079562 A1 Apr. 3, 2008

(51) Int. Cl.
*G08B 1/00* (2006.01)

(52) U.S. Cl.
CPC ..... *G08B 1/00* (2013.01)
USPC ..... 379/102.01; 379/102.06; 379/102.07

(58) Field of Classification Search
USPC ..... 379/102.06, 102.07, 102.01, 110.01, 379/167.01–167.11, 37–51
See application file for complete search history.

(56) References Cited

U.S. PATENT DOCUMENTS

| | | | | |
|---|---|---|---|---|
| 3,978,475 | A | 8/1976 | Schmitz | |
| 4,554,411 | A | 11/1985 | Armstrong | |
| 4,701,884 | A * | 10/1987 | Aoki et al. | 365/189.09 |
| 4,731,821 | A | 3/1988 | Jackson, III | |
| 5,428,388 | A | 6/1995 | von Bauer et al. | |
| 6,748,061 | B2 * | 6/2004 | Ahlstrom et al. | 379/102.06 |
| 6,796,084 | B2 | 9/2004 | Gagnon | |
| 7,065,196 | B2 | 6/2006 | Lee | |
| 2005/0190053 | A1 | 9/2005 | Dione | |
| 2006/0214767 | A1 | 9/2006 | Carrieri | |
| 2007/0096872 | A1 * | 5/2007 | Nguyen et al. | 340/5.61 |

OTHER PUBLICATIONS

Deposition Upon Oral Examination, vol. I; US District Court—Western District of Washington at Tacoma; Case No. C09-5438 BHS; Jul. 7, 2010.
Motion in Limine—Oral Argument Requested; US District Court—Western District of Washington at Tacoma; Case No. C09-5438 BHS; Oct. 21, 2010.
Defendant's Opposition to Plaintiff's Motion in Limine; US District Court—Western District of Washington at Tacoma; Case No. C09-5438 BHS; Nov. 23, 2010.
Jan. 7, 2011 Opposition to Chamberlain's Motion to Exclude Evidence of Chamberlain's Use of IEI Intellectual Property; US District Court—Western District of Washington at Tacoma; Case No. C09-5438 BHS.
Plaintiff's Supplemental Brief Regarding Chamberlain's Patent Applications; US District Court—Western District of Washington at Tacoma; Case No. C09-5438 BHS; Jul. 7, 2011.
Transcript of Proceedings Before the Honorable Benjamin H. Settle United States District Judge; US District Court—Western District of Washington at Tacoma; Case No. C09-5438 BHS; Dec. 15, 2010.
Plaintiff's Motion in Limine; US District Court—Western District of Washington at Tacoma; Case No. C09-5438 BHS; Nov. 15, 2010.

(Continued)

*Primary Examiner* — Melur Ramakrishnaiah
(74) *Attorney, Agent, or Firm* — Fitch Even Tabin & Flannery LLP

(57) ABSTRACT

An access control system is provided for a movable barrier. A main communication unit grants access to a movable barrier operator. The movable barrier operator controls movement of the movable barrier. A remote communication unit has an input device to receive an access request and to transmit a corresponding access signal to the main communication unit and to transmit a status indication to the main communication unit in response to detecting a predetermined event.

25 Claims, 4 Drawing Sheets

(56) References Cited

OTHER PUBLICATIONS

Plaintiff's Brief in Opposition to Defendant's Motion in Limine; US District Court—Western District of Washington at Tacoma; Case No. C09-5438 BHS; Nov. 1, 2010.
Declaration in Support of Response to Motion in Limine; US District Court—Western District of Washington at Tacoma; Case No. C09-5438 BHS; Nov. 1, 2010.
Declaration in Support of Motion in Limine; US District Court—Western District of Washington at Tacoma; Case No. C09-5438 BHS; Oct. 21, 2010.
IEI, "Oracle 3000 Wire-Free Gate System", dated Feb. 22, 2006, 9 pages.
"Liftmaster, Model LA100, Owner's Manual", revision dated May 14, 2008, 2 pages.
Underwriters Laboratories, UL Standard for Safety for Door, Drapery, Gate, Louver, and Window Operators and Systems, UL 325, dated Jan. 16, 1998, 74 pages.
Underwriters Laboratories, UL Standard for Safety for Door, Drapery, Gate, Louver, and Window Operators and Systems, UL 325, dated Sep. 18, 1998, 92 pages.
Canadian Patent Office, Office Action mailed Dec. 19, 2013, from corresponding Canadian Patent Application No. 2,604,669, 2 pages.

* cited by examiner

INTERCOM UNIT FOR PROVIDING A STATUS ALERT FOR A MOVABLE BARRIER

TECHNICAL FIELD

This invention relates generally to an intercom system for a movable barrier, and more particularly to an intercom system to communicate with a main communication unit inside a dwelling and to provide status alerts of various conditions of the movable barrier.

BACKGROUND

There are currently telephone entry systems for granting access to a gate or door. These systems typically include a remote unit accessible to someone desiring to gain entry to the gate or door. By depressing a specified button or entering a code via the remote unit, a call is made to a person within a dwelling typically accessible via the gate or door. The person within the dwelling can then grant access to the person at the gate or door by, for example, pressing an access button into a main unit within the dwelling. Upon granting access from the dwelling, a gate operator at the gate or door is enabled such that the person at the gate or door can press another button to open the gate or door. Such telephone entry systems, however, are often complex and expensive.

Gate intercoms are becoming the low cost alternative to the telephone entry system. Current gate intercoms are hardwired and typically include their own wiring and therefore do not need to utilize existing telephone wires within the dwelling. A gate intercom allows a person to approach the gate and request access. The access can be performed by activation of the gate from the dwelling or activation of the operator from the intercom unit by the person at the gate.

There are certain situations where the gate operator may detect operational status situations. For example, the gate operator may detect that someone is trying to break into the gate. As a second example the gate operator might also detect an obstruction and react to protect so as to avoid opening or closing over the obstruction. The gate operator may take corrective action in response to a detected operational status situation. For example, in the event that an obstruction is detected, the gate may reverse the direction of movement of the gate.

Current gate systems, however, typically do not notify the homeowner of these situations. Accordingly, in the event of an obstruction or malfunction of the gate, the main unit within the dwelling is not notified.

SUMMARY OF THE INVENTION

The present invention is directed to an access control system for a movable barrier. A main communication unit may grant access to person located at the movable barrier. The main communication unit may be located within a dwelling, such as a house, or in some other location remote to the movable barrier operator. The movable barrier operator controls movement of the movable barrier. A remote communication unit located at, or near, the movable barrier operator has an input device to receive an access request and to transmit a corresponding access request signal to the main communication unit. The remote communication unit may comprise a gate intercom. The remote communication unit may transmit a status indication or signal to the main communication unit in response to detecting a predetermined condition or event. The predetermined event may comprise, for example, an obstruction. The status indication or signal may also be transmitted at periodic intervals regardless of whether a predetermined condition or event is detected. The status signal may be transmitted every few seconds, minute, 5 minutes, 15 minutes, or any other suitable interval of time.

The present invention is further directed to a method for controlling a movable barrier. As an example, an access request is received at a main communication unit from an input device of a remote communication unit. A corresponding access grant signal is transmitted to the remote communication unit in response to the receiving. Access is then granted through the remote communication unit. Movement of the movable barrier is controlled and the movable barrier is commanded to perform movable barrier functions in response to receiving the access grant signal. A status indication or signal may be transmitted from the remote communication unit to the main communication unit in response to detecting a predetermined event such as, for example, an obstruction. Also, the status indication or signal may be transmitted to the main communication unit at periodic time intervals regardless of whether the predetermined event is detected.

The present invention is further directed to an access control device for a movable barrier. An input device receives an access request. A transmitter may transmit an access request signal corresponding to the access request to a main communication unit and may transmit a status indication or signal to a main communication unit in response to detecting a predetermined condition or event. The status indication or signal may also be periodically transmitted to the main communication unit to inform of a current status of the movable barrier operator. The main communication unit is adapted to grant access to a person located at the movable barrier operator. The moveable barrier operator controls movement of the movable barrier. A receiver receives an access grant from the main communication unit.

By periodically informing the main communication unit of the status of the movable barrier operator and requesting access from the main communication unit, the operation of the movable barrier operator may be closely monitored by a person near the main communication unit, providing the person with a relatively large degree of control over operation of the movable barrier operator.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The above needs are at least partially met through provision of the method and apparatus for remote control described in the following detailed description, particularly when studied in conjunction with the drawings, wherein.

Figure 1:
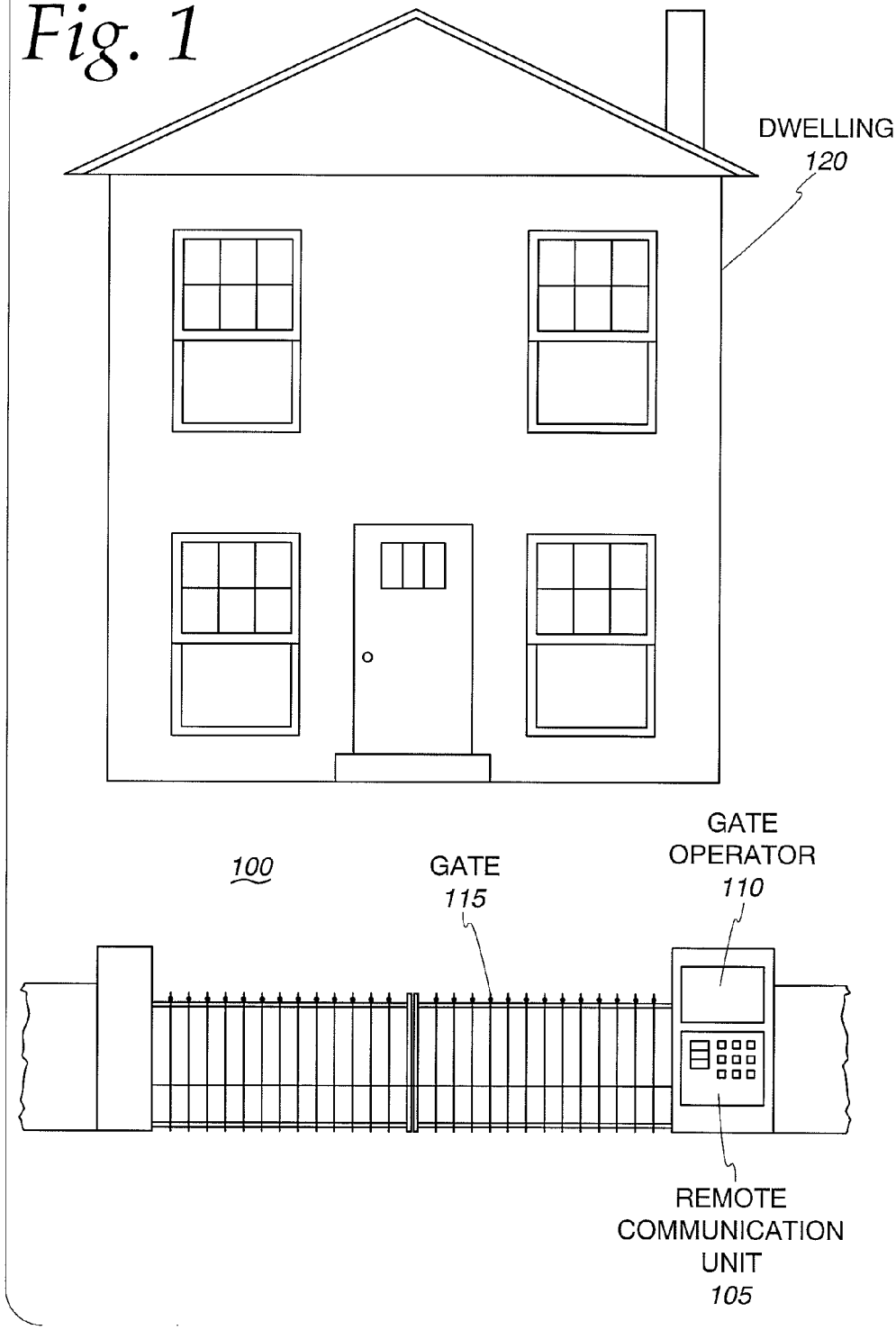
FIG. 1 illustrates a movable barrier system according to at least one embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION

Generally speaking, pursuant to these various embodiments, a remote communication unit, such as a gate intercom, is provided that communicates with a main communication unit within a dwelling such as a house or building. The remote communication unit may integral with, or in communication with, a movable barrier operator for moving a movable barrier. The movable barrier may be a gate or door to a property, an estate, or some other restricted area. Some embodiments are described below with respect to use of a gate. However, it should be appreciated that these teachings are also applicable to any other type of movable barrier system.

When the gate is in a closed position, a person may approach the remote communication unit and press a button or enter a code on a keypad to request access to open or raise the gate. In the event that the user enters a specified code, the user may be granted access to the gate operator to cause the gate operator to open the gate. Alternatively, if the user does not know this code, the user may request access to the gate operator from a person within the dwelling.

A communication signal corresponding to the access request is subsequently sent to the main communication unit within the dwelling. The main communication unit may include a keypad, a speaker, a video display, or any other type of communication interface. When the main communication unit receives the communication signal, the main communication unit may alert a person within the dwelling of the presence of someone desiring to open the gate. If the person within the dwelling chooses to allow the person at the remote communication unit to enter, the person within the dwelling may enter a code or depress a predetermined button on the main communication unit to transmit an access grant signal back to the remote communication unit. This access grant signal may be received by a receiver within the remote communication unit or within the operator itself. In one embodiment, upon receipt of this access grant signal, the remote communication unit grants control of the gate operator so that the person at the remote communication unit can press a button to open the gate or perform some other function. In another embodiment, this access grant signal directly opens the gate instead of granting access to the gate operator.

The gate operator also periodically transmits a status signal to the main communication unit. In embodiments where the gate operator is integral with the remote communication unit, the gate operator may utilize the same transmitter as is used to transmit the access request to the main communication unit. In other embodiments in which the gate operator is separate from the remote communication device, the gate operator may either communicate via a transmitter and receiver or a transceiver within the remote communication unit or may utilize its own transmitter and receiver or transceiver. Various statuses may be sent to the main communication unit. For example, status updates may be transmitted upon detecting an attempt to force open the gate, a reversal performed by the gate operator in response to a force obstruction of the gate, a reversal performed by the gate operator in response to a secondary obstruction, two consecutive obstruction caused reversals, something called an "E2 safety level," and an activation of a main communication unit warning device of the remote communication device. For example, the main communication unit warning device may comprise a "panic button" to be pressed when someone at the gate requests help such as, for example, when the person is being physically attacked by a criminal.

FIG. 1 illustrates a movable barrier system 100 according to at least one embodiment of the invention. The system 100 includes a remote communication unit 105, a gate operator 110, a gate 115, and a main communication unit (not shown) disposed within a dwelling 120. The gate 115 is utilized to restrict access to an area around a dwelling 120, building, or some other structure, for example. In the event that a person knowing a predetermined entry code desires to enter onto the property so as to access the dwelling 120, the person may initially approach the remote communication unit 105. The remote communication unit 105 may include a keypad or other input device, as described below with respect to FIG. 2. Upon entry of the predetermined code, access is granted to the gate operator 110 in order to cause the gate operator 110 to open or raise the gate 115. In some embodiments after it is determined that the correct code has been entered, the gate 115 automatically opens or raises itself. In other embodiments, the user must press a certain button or key on the remote communication unit to send an instruction to the gate operator 110 to open or raise the gate 115.

The gate operator 110 is shown as being physically separate from the remote communication unit in FIG. 1. In such embodiment, the remote communication unit 105 is in communication with the gate operator 110 via a wired connection or a wireless connection. The wireless connection may be made via any suitable wireless technology, such as Infra-Red ("IR"), Radio Frequency ("RF"), sound, ultrasonics, and visible light.

In other embodiments, however, the gate operator 110 and the remote communication unit 105 may be integral. In other words, the gate operator 110 and the remote communication unit 105 may be part of a single unit.

In the event that a visitor or someone who does not know a permitted code desires to open or raise the gate 115, the person may press a button or series of buttons on the remote communication unit 105 and a corresponding signal is sent to a main communication unit (FIG. 3) within the dwelling. The signal may be sent via a wired connection between the remote communication unit 105 and the main communication unit within the dwelling 120. Alternatively, the signal may be sent wirelessly via, for example, IR, RF, sound, ultrasonics, and visible light.

Upon receipt of the signal, the main communication unit may signal to a person within the dwelling that someone is requesting that the gate 115 be opened or raised. The signal to the person within the dwelling may be made via an audible noise, such as a beep or series of beeps, or in some other perceptible manner such as by flashing a light, such as a Light Emitting Diode ("LED") or a set of LEDs on or in communication with the main communication unit.

If the person chooses to deny access, the person may ignore the request, and press a button or enter a code on the main communication unit to indicate that access is denied. On the other hand, if the person chooses to grant access, the person may press another button or enter a code on the main communication unit to indicate that the access is granted. In the event that the person within the dwelling grants access, an access grant signal is sent to the remote communication unit 105. The access grant signal may be sent via a wired connection or via a wireless connection, such as IR, RF, sound, ultrasonics, and visible light.

The gate operator 110 also includes a sensor to detect certain operating conditions for the gate 115, as discussed below with respect to FIG. 2. Some conditions that may be detected by the sensor include an attempt to force open the gate 115, a reversal of the gate 115 performed by the gate operator 110 in response to a force obstruction of the gate 115, a reversal performed by the gate operator 110 in response to a secondary obstruction, two consecutive reversals of the gate 115 creating an E2 safety level, and an activation of a main communication unit warning device.

Figure 2:
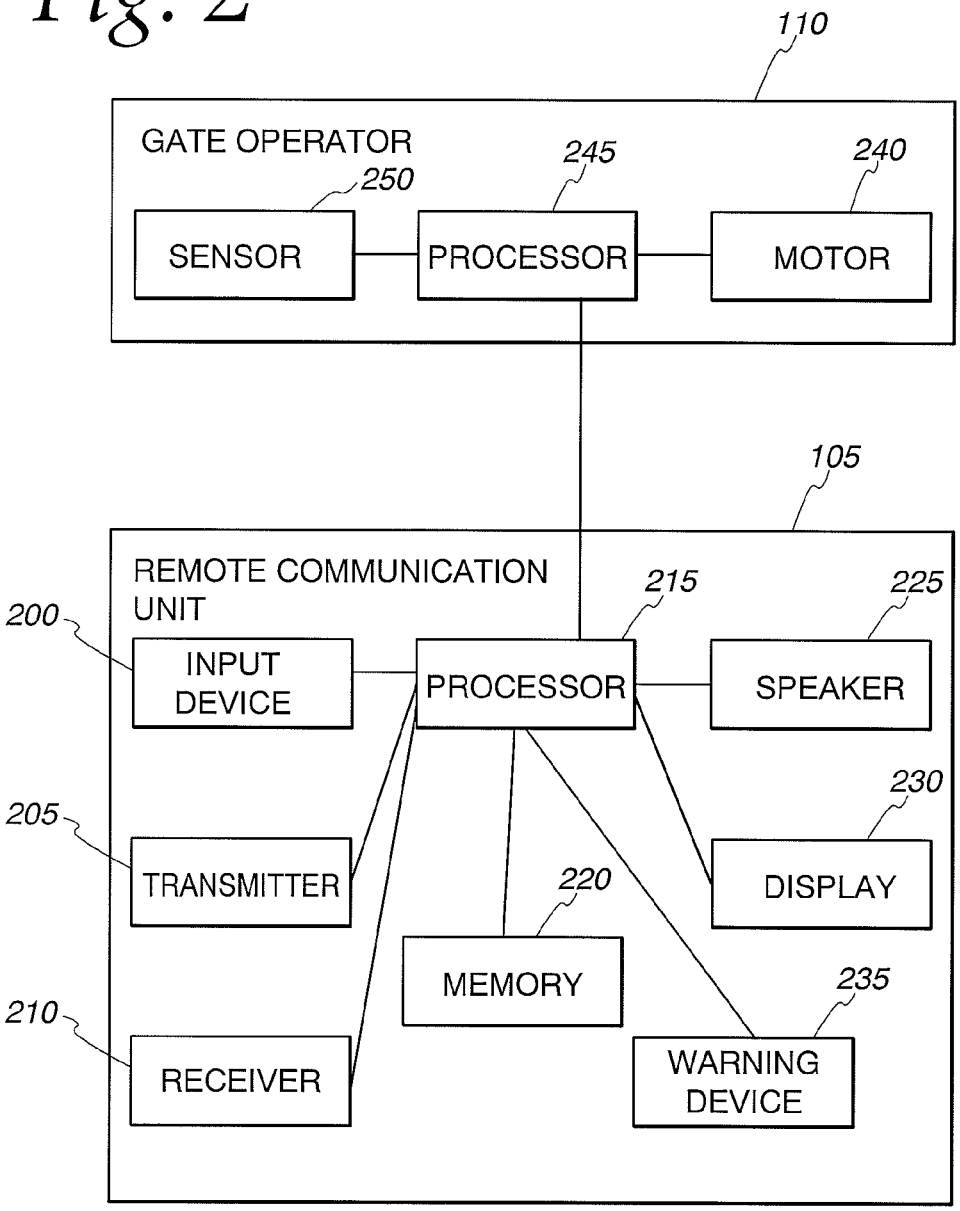
FIG. 2 illustrates a remote communication unit and a gate operator according to at least one embodiment of the invention.

FIG. 2 illustrates a remote communication unit 105 and a gate operator 110 according to at least one embodiment of the invention. As shown, the remote communication unit 105 may include an input device 200, a transmitter 205, a receiver 210, a processor 215, a memory 220, a speaker 225, a display 230, and a warning device 235. The input device 200 may be utilized to receive an input from a person desiring to open or raise the gate 115. As discussed above, the input device 200 may include a keypad, a set of buttons, or any other suitable device for receiving an input from the person. The transmitter 205 is utilized to transmit a signal to the main communication unit to indicate that someone desires to open or raise the gate 115. As discussed above, the transmitter 205 may transmit via a wired connection or via a wireless connection. The receiver 210 receives access grant signals from the main communication unit within the dwelling 120. Alternatively, a single transceiver may be utilized instead of a separate transmitter 205 and receiver 210.

A processor 215 controls the various elements or devices with the remote communication unit 105. The processor 215 may implement or run program instructions or code stored within the memory 220. The speaker 225 may be utilized to allow the person at the remote communication unit 105 to speak with a person within the dwelling 120. The display 230 may be utilized to illustrate written instructions or a message for, for example, a person within the dwelling 120. It should be appreciated that in some embodiments, the speaker 225 and the display 230 are not utilized or present. The warning device 235 may comprise a "panic button" to be pressed when someone at the gate 115 requests help such as, for example, when the person is being physically attacked by a criminal. The warning device 235 is not required and may not be included in some embodiments.

In addition to the motor 240, the gate operator 110 also includes a sensor 250 and a processor 245. The sensor 250 may be utilized to detect certain operating conditions. As discussed above, some conditions that may be detected by the sensor 250 include an attempt to force open the gate 115, a reversal of the gate 115 performed by the gate operator 110 in response to a force obstruction of the gate 115, a reversal performed by the gate operator 110 in response to a secondary obstruction, two consecutive reversals of the gate 115 creating an E2 safety level, and an activation of a main communication unit warning device. The processor 245 may control both the sensor 250 and the motor 240. When the sensor 250 detects the predetermined conditions, a status signal or alert is transmitted to the main communication unit within the dwelling to indicate the condition.

Figure 3:
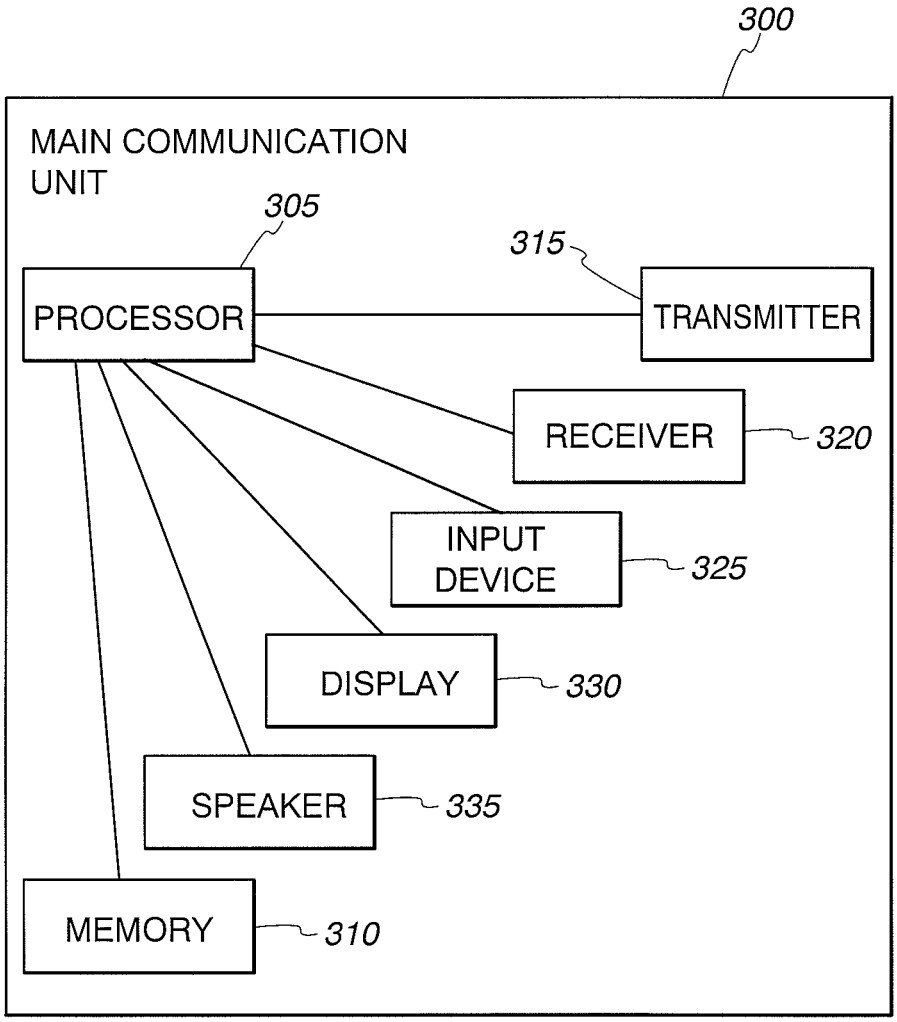
FIG. 3 illustrates a main communication unit according to at least one embodiment of the invention.

FIG. 3 illustrates a main communication unit 300 according to at least one embodiment of the invention. As shown, the main communication unit 300 includes a processor 305, a memory 310, a transmitter 315, a receiver 320, an input device 325, a display 330, and a speaker 335. As discussed above, the main communication unit 300 may be disposed within the dwelling 120 of FIG. 1 and may be utilized to receive status alerts and access requests from a person at the remote communication unit 105. The main communication unit 300 may also sent access grant signals back to the remote communication unit 105.

The processor 305 controls the various elements within the main communication unit 300. The memory 310 may stored program code or instructions to be executed by the processor 305. The transmitter 315 may transmit access grants to the remote communication unit 105. The transmitter 315 may also transmit a status request to the remote communication unit 105 to identify, for example, the current status of the gate 115 and/or the gate operator 110.

The receiver 320 receives status alerts and access request signals from the remote communication unit 105. The input device 325 may be utilized to grant or deny access for the gate operator to the remote communication unit. The display 330 may be utilized to illustrate written instructions or a message for, for example, a person within the dwelling 120. The speaker 335 may be utilized to allow the person at the main communication unit 300 to speak with a person at the remote communication unit 105. It should be appreciated that in some embodiments, the speaker 335 and the display 330 are not utilized or present.

Figure 4:
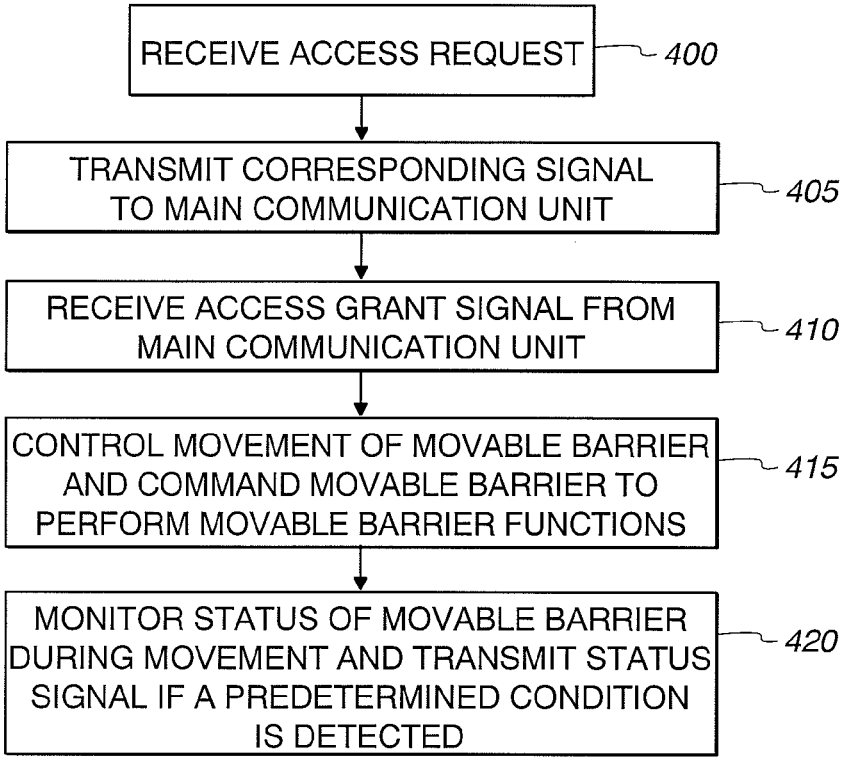
FIG. 4 illustrates a method of operating a movable barrier according to at least one embodiment of the invention.

FIG. 4 illustrates a method of operating a movable barrier, such as gate 115, according to at least one embodiment of the invention. First, at operation 400, an access request is received. The access request may be made by, for example, a person at the remote communication unit 105 entering a code or pressing a specified button of the input device 200, as discussed above with respect to FIG. 2. Next, at operation 405, a corresponding access request signal is transmitted to the main communication unit 300. An access grant signal is then received from the main communication unit 300 at operation 410. Movement of the gate 115 is controlled at operation 415 and the gate 115 is commanded to perform gate 115 functions at operation 415. Finally, at operation 420, the status of the movable barrier during the movement is monitored and a status signal is transmitted to the main communication unit 300 if one of a set of predetermined conditions is detected. This signal may be sent wirelessly or via a wired connection.

Figure 5:
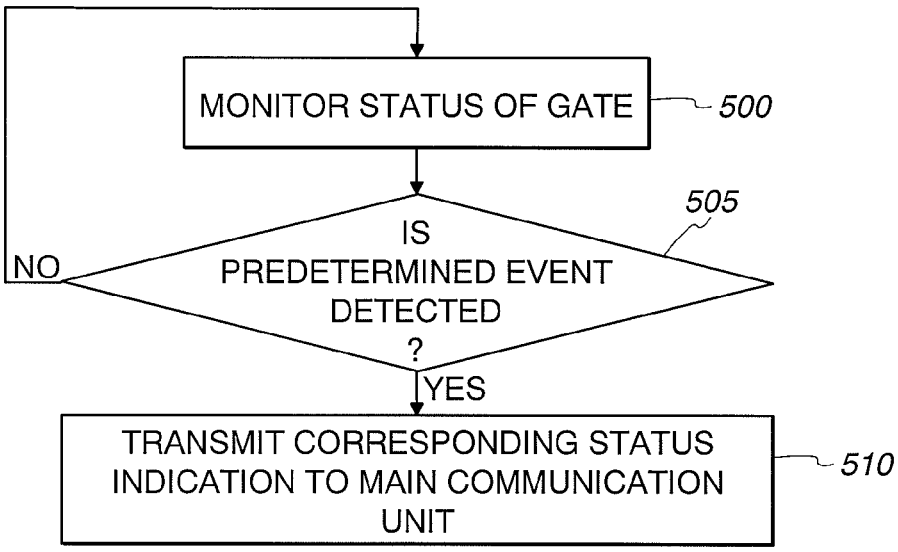
FIG. 5 illustrates a method of monitoring and reporting a status of a movable barrier according to at least on embodiment of the invention.

FIG. 5 illustrates a method of monitoring and reporting a status of a movable barrier, such as the gate 115, according to at least on embodiment of the invention. First, at operation 500, the status of the gate 115 is monitored. The status may be monitored by the sensor 250 of the gate operator 105, as shown in FIG. 2. Next, a determination is made as to whether a predetermined event is detected by the sensor 250. The predetermined event may include any occurrence affecting operation of the gate 115 or gate operator 105 or indicating that someone or something is tampering with the gate 115 or gate operator 105, as discussed above with respect to FIG. 3.

The determination may be made by the processor 245 of the gate operator 105. If "no" at operation 505, processing returns to operation 500. If "yes," on the other hand, processing proceeds to operation 510 where a corresponding status indication signal is sent to the main communication unit 300. As stated above, this signal may be sent wirelessly or via a wired connection.

Generally speaking, pursuant to these various embodiments, a remote communication unit, such as a gate intercom, is provided that communicates with a main communication unit within a dwelling such as a house or building. The remote communication unit may integral with, or in communication with, a movable barrier operator for moving a movable barrier. The movable barrier may be a gate or door to a property or estate.

When the gate is in a closed position, a person may approach the remote communication unit and press a button or enter a code on a keypad to request access. In the event that the user enters a specified code, the user may be granted access to the gate operator to cause the gate operator to open the gate. Alternatively, if the user does not know this code, the user may request access to the gate operator from a person within the dwelling.

A communication signal corresponding to the request is subsequently sent to the main communication unit within the dwelling. When the main communication unit receives the communication signal, the main communication unit alerts a person within the dwelling of the presence of someone desiring to open the gate. If the person within the dwelling chooses to allow the person at the remote communication unit to enter, the person within the dwelling may enter a code or depress a predetermined button on the main communication unit to transmit an access grant signal back ton the remote communication unit. This access grant signal may be received by a receiver within the remote communication unit. Upon receipt of this access grant signal, the remote communication unit grants access to the gate operator so that the person at the remote communication unit can press a button to open the gate or perform some other function. Alternatively, this access grant signal directly opens the gate instead of granting access to the gate operator.

The gate operator also periodically transmits a status signal to the main communication unit. In other embodiments in which the gate operator is separate from the remote communication device, the gate operator may either communicate via a transmitter and receiver or transceiver within the remote communication unit or may utilize its own transmitter and receiver or transceiver. Various statuses may be sent to the main communication unit, including detection of an attempt to force open the movable barrier, a reversal performed by the movable barrier operator in response to a force obstruction of the movable barrier, a reversal performed by the movable barrier operator in response to a secondary obstruction, two consecutive reversals creating an E2 safety level, an activation of a main communication unit warning device, or any other any other event adversely affecting operation of the movable barrier or movable barrier operator or indicating that someone or something is tampering with the movable barrier or movable barrier operator.

By transmitting the status of the movable barrier or in response to detection of certain conditions, a person within the dwelling is quickly informed of a faulty operating condition or whether someone or something is tampering with the movable barrier. Accordingly, problems with the movable barrier may be quickly corrected by a person within the dwelling to minimize the possibility of someone being injured by the movable barrier or an intruder manipulating his or her way past the movable barrier.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. An access control system for a movable barrier, the access control system comprising:

a main communication unit to grant access to a movable barrier operator, wherein the movable barrier operator controls movement of the movable barrier; and a remote communication unit having an input device to receive an access request and to transmit a corresponding access request signal to the main communication unit and to transmit a status indication to the main communication unit in response to detecting a predetermined event comprising two consecutive reversals creating an E2 safety level.

2. The access control system of claim 1, wherein the remote communication unit wirelessly transmits at least one of the corresponding access request signal and the status indication to the main communication unit.

3. The access control system of claim 2, wherein the at least one of the corresponding access request signal and the status indication is wirelessly transmitted via at least one of Infra-Red, Radio Frequency, sound, ultrasonics, and visible light.

4. The access control system of claim 1, wherein the remote communication unit transmits at least one of the corresponding access request signal and the status indication to the main communication unit via a wired connection between the remote communication unit and the main communication unit.

5. The access control system of claim 1, wherein the main communication unit is disposed within a dwelling and the remote communication unit is disposed outside of the dwelling.

6. The access control system of claim 1, wherein the movable barrier is one of a gate and a garage door.

7. The access control system of claim 1, wherein the predetermined event comprises a detection of a movable barrier operation different from a commanded movable barrier operation commanded by the access control system.

8. The access control system of claim 1, wherein the input device comprises a keypad.

9. The access control system of claim 1, wherein the main communication unit is configured to direct the remote communication unit to perform a status check of the movable barrier and the movable barrier operator.

10. A method for controlling a movable barrier, the method comprising:

receiving an access request from an input device of a remote communications unit;

transmitting a corresponding access request signal to a main communication unit in response to the receiving;

receiving an access grant signal from the main communication unit;

controlling movement of the movable barrier and commanding the movable barrier to perform movable barrier functions in response to receiving the access grant signal;

transmitting a status indication to the main communication unit in response to detecting a predetermined event comprising two consecutive reversals creating an E2 safety level.

11. The method of claim 10, wherein at least one of the transmitting the corresponding access request signal and the transmitting the status indication is performed wirelessly.

12. The method of claim 11, wherein the at least one of the corresponding access request signal and the status indication is wirelessly transmitted via at least one of Infra-Red, Radio Frequency, sound, ultrasonics, and visible light.

13. The method of claim 10, wherein at least one of the transmitting the corresponding access request signal and the transmitting the status indication is performed via a wired connection between the remote communication unit and the main communication unit.

14. The method of claim 10, wherein the main communication unit is disposed within a dwelling and the remote communication unit is disposed outside of the dwelling.

15. The method of claim 10, wherein the detecting the predetermined event comprises detection of a barrier operation different from a commanded movable barrier operation commanded by an access control system.

16. The method of claim 11, further comprising the main communication unit directing the remote communication unit to perform a status check of the movable barrier and the movable barrier operator.

17. An access control device for a movable barrier, the access control device comprising:

an input device to receive an access request;

a transmitter to transmit an access signal corresponding to the access request to a main communication unit and to transmit a status indication to a main communication unit in response to detecting a predetermined event comprising two consecutive reversals creating an E2 safety level, the main communication unit being adapted to grant access to a movable barrier operator, the moveable barrier operator controlling movement of the movable barrier; and a receiver to receive an access grant from the main communication unit.

18. The access control device of claim 17, wherein the transmitter is adapted to wirelessly transmit at least one of the corresponding access signal and the status indication to the main communication unit.

19. The access control device of claim 18, wherein the at least one of the corresponding access signal and the status indication is wirelessly transmitted via at least one of Infra-Red, Radio Frequency, sound, ultrasonics, and visible light.

20. The access control device of claim 17, wherein the transmitter is adapted to transmit at least one of the corresponding access signal and the status indication to the main communication unit via a wired connection between the remote communication unit and the main communication unit.

21. The access control device of claim 17, wherein access control device is disposed outside of a dwelling and the main communication unit is disposed within the dwelling.

22. The access control device of claim 17, wherein the movable barrier is one of a gate and a garage door.

23. The access control device of claim 17, wherein the input device comprises a keypad.

24. The access control device of claim 17, wherein the predetermined event comprises a detection of a movable barrier operation different from a commanded movable barrier operation commanded by the access control device.

25. The access control device of claim 17, wherein the main communication unit is configured to direct a remote communication unit to perform a status check of the movable barrier and the movable barrier operator.

* * * * *